343-902 SR
1/30/79 OR 4,137,535

United States Patent [19]
Rupprecht

[11] 4,137,535
[45] Jan. 30, 1979

[54] TELESCOPING ANTENNA MAST

[76] Inventor: Walter Rupprecht, Am Storksberg 8, Linsengericht 1, Fed. Rep. of Germany, 6464

[21] Appl. No.: 831,987

[22] Filed: Sep. 9, 1977

[30] Foreign Application Priority Data

Sep. 17, 1976 [DE] Fed. Rep. of Germany ..... 7629017

[51] Int. Cl.² ..... H01Q 1/04
[52] U.S. Cl. ..... 343/902; 52/118
[58] Field of Search ..... 343/902, 901; 52/115, 52/118

[56] References Cited

U.S. PATENT DOCUMENTS 2,646,504 7/1953 Gosline ..... 343/902

*Primary Examiner*—Alfred E. Smith
*Assistant Examiner*—David K. Moore
*Attorney, Agent, or Firm*—W. G. Fasse; D. F. Gould

[57] ABSTRACT

The present antenna mast is constructed to telescope in response to pneumatic pressure. For this purpose a bottom tubular section has a pressure inlet and each further tubular section has a lower end fitting as a piston into the next lower section. Each piston has a passage for a gas under pressure into the next higher section. The upper end of the uppermost section is closed. The antenna is retracted by venting the bottom tubular section.

12 Claims, 1 Drawing Figure

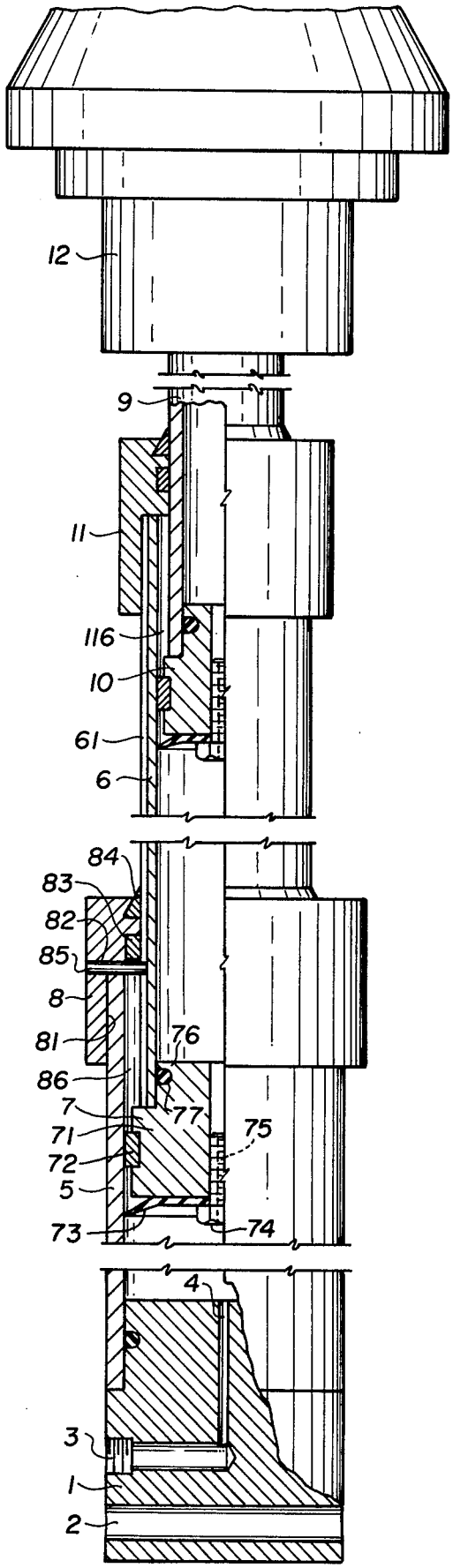
12
9
11
116
10
61
6
84
83
82
85
8
81
86
7
71
72
5
73
76
77
75
74
4
3
1
2

TELESCOPING ANTENNA MAST

BACKGROUND OF THE INVENTION

The present invention relates to a telescoping antenna mast. More specifically, the present mast is constructed of a plurality of cylindrical tubular sections or members inserted into each other in a telescopic manner so that the antenna mast may be extended and retracted by mechanical or pressure means to vary the total height or length of the antenna mast within a predetermined working range.

Prior art masts are either operated by hydraulic means or by mechanical crank operated drive means which are frequently employed in combination with expensive wooden or steel framework structures providing the necessary support. The disadvantage of such structures is seen not only in the fact that the support structures are rather involved and hence expensive but also in the fact that the hydraulic drive mechanism may spring a leak, thereby contaminating the environment. Still another disadvantage is seen in that the time required for setting up these antennas with their supporting structures including the guy wires is substantial.

Such supporting structures are necessary for prior art telescoping antennas due to the substantial weight of these prior art antennas.

Other disadvantages of prior art antennas are seen in that a substantial length of time is required to disassemble the antenna and support structure if moving the antenna is required. Furthermore, the structural design of the support structure must take into account the maximum wind conditions, whereby it is usually difficult, having regard to the antenna weight, to eliminate the dangers to the antenna itself. Thus, prior art antennas with their heavy weight and bulky support structures are a problem, especially for the ham amateur.

Further with regard to hydraulically operated antenna masts it should be mentioned that the hydraulic drive mechanisms operate the controlled elements in a hard manner so that the antenna components are subject to a jerky operation which does not contribute to the length of the useful life of such hydraulically operated antennas. Further, it has been past experience that prior art antennas, although constructed for mobile use, are, due to their weight and bulkiness, not really adapted for such mobile use. Frequently, the antennas used in such environments as just mentioned, are the cause of bottle necks.

OBJECTS OF THE INVENTION

In view of the above, it is the aim of the invention to achieve the following objects, singly or in combination:

to produce a telescoping antenna mast which is lightweight and which assures a rapid, while simultaneously safe, extension and retraction;

to provide an antenna structure which will not adversely affect its environment with bulky supporting structures and which will avoid oil leaks and the like;

to provide a telescoping antenna mast which may be easily and rapidly assembled and disassembled with a minimum of technical effort;

to provide an antenna mast which will satisfy the requirements of the ham amateur and which may be used even in limited available space, thereby satisfying the requirements of the ham operator in an optimal manner;

to construct a telescoping antenna mast which may be operated for extension and retraction without any jerky movements;

to construct a telescoping antenna so that in its retracted state the structural length will be minimized to facilitate its installation on vehicles and the like; and to minimize the gas pressure inlet and venting means.

SUMMARY OF THE INVENTION

According to the invention, there is provided a telescoping antenna mast which is operable by pneumatic means, whereby the extension and retraction of the antenna may be accomplished substantially without any jerky movements of the mast elements since the gaseous pressure means are compressible, thereby acting as a damper.

A preferred embodiment according to the invention comprises a bottom tubular member with a closed end which receives the hollow tubular sections when the antenna is retracted except for a bushing member which surrounds each upper end of each antenna tubular member in a sliding manner. All antenna sections or members are provided with such a bushing at their upper end, except the topmost section. The bottom member of the tubular sections is provided with a closed end as well as passage means for the inlet and outlet of a gaseous pressure medium. Each telescoping tubular member, except the bottom member, is provided with a piston at its inner end and the piston in turn is provided with an air or gas passage having a cross sectional area adapted to the cross sectional area of the space confined in the respective tubular member. Thus, the pressure medium which is introduced initially in the bottom tubular member advances from one member into the other in series fashion so to speak. The top tubular member is closed at its upper end. Preferably, each telescoping tubular member is provided with a longitudinal groove in the outer surface of its tubular wall. The slide bushings at the upper end of each tubular member, except the uppermost tubular member, hold a guide pin or the like which fits into the respective groove, thereby permitting an axial movement of the tubular members relative to each other but simultaneously preventing any rotational movement of the individual tubular members.

This type of construction has the advantage that it makes possible a short over-all length of the antenna mast in its retracted condition, whereby the entire structure is especially suitable for installation on vehicles by simple means and the entire apparatus is easily to be handled.

The gas passages through the cylinder portions of each tubular member and through the bottom of the lowermost tubular member are correlated and adjusted relative to each other whereby it is possible to provide a practically exact control of the extending and lowering movements of the antenna mast components. This applies especially with regard to the time required for the extension and retraction of the antenna mast components, whereby the cross sectional area of these gas passages may be controlled, for example, by orifices of variable cross section and the orifices themselves may be exchangeable to facilitate repairs, if any.

Another advantage of the structure according to the invention is seen in that the venting and air supply to a dead space between the inner diameter of a lower tubular section and the outer diameter of an upper tubular section, as viewed in the radial direction, and the piston member, as well as a closure means at the top of the respective sliding bushing, as viewed in the axial direction, is accomplished by the above mentioned groove, whereby the guide pin is dimensioned relative to the groove so as to provide for said venting and air supply. This feature of the invention obviates any separate elements for the venting and air supply of the dead spaces between adjacent tubular members.

The antenna sections are easily retractable by a venting of the lowermost or base section or member, preferably through the passage through which the pressure medium is admitted. Cross sectional area determining means may also be provided for this purpose, for example, valves or orifices may be inserted in the air passages.

BRIEF FIGURE DESCRIPTION

In order that the invention may be clearly understood, it will now be described, by way of example, with reference to the accompanying drawings, wherein the single FIGURE illustrates a side view, partially in section, of an antenna mast according to the invention.

DETAILED DESCRIPTION OF PREFERRED EXAMPLE EMBODIMENTS

The bottom section 1 of the present antenna mast has a bore 2 therethrough by means of which the entire antenna mast may be secured in a journalling manner to a support structure not shown. The journal pin extending through the bore 2 is also not shown but well known in the art. The foot section 1 has further a bore 3 extending radially into the lower tubular section. The outer end of the bore 3 may be provided with a threading for securing a hose or pipe connected to a pneumatic source of pressure not shown. The radial bore 3 extends into an axial bore 4 having a predetermined cross sectional area or orifice size leading into the hollow space confined by the lowest hollow tubular member 5 of the antenna mast. The member 5 cooperates with the next higher tubular section 6 which in turn cooperates with the next higher tubular section 9 and so forth. The tubular member 6 is guided along the inner wall surfaces of the tubular member 5 by means of a piston substantially closing the lower end of the tubular member 6 inside the tubular member 5, except for a gas pressure 75 to be described in more detail below. The member 6 is further guided by a slide bushing 8 which may, for example, be screwed onto the upper end of the tubular member 5.

Incidentally, the bore 3 and its axial extension 4 are intended for the pressure supply as well as for the venting of the tubular member 5, for example, through conventional valve means not shown but connected to the threading of bore 3.

The piston 7 comprises a lower guide portion 71 proper surrounded by a guide ring or band 72. To the bottom of the piston 7 there is secured a cup sealing member 73 by means of a screw 74 which is provided with an axial bore or orifice 75 acting as a gas passage for admission of gas under pressure as well as a venting means. An upper portion 76 of the piston 7 has a reduced diameter relative to the guide portion 71, whereby the next higher tubular member 6 fits with a press fit, for example, around said upper section 76 of the piston 7. An O ring 77 seals the piston 7, or rather its upper end 76, relative to the tubular member 6. Since one of the orifices 75 is provided in the bottom piston 7, 10 of each tubular member 6, 9 pressure gas may be admitted or vented from these tubular members in succession.

The slide bushing 8 functions simultaneously as a closure member for the upper end of the tubular member 5. For this purpose the bushing 8 has a larger diameter bore 81 fitting over the outer surface of the tubular member 5, for example, by a screw connection. The bushing 8 has a further bore 82 fitting in a gliding manner over the outer diameter of the tubular member 6. The sealing between the bushing 8 and the tubular members may be accomplished by a press fit, especially relative to tubular member 5 or a gasket may be provided as shown at 84 to provide a seal and simultaneously permitting for the sliding movement of the tubular member 6. The gasket 84 forms a sleeve around the tubular member 6 thereby simultaneously acting as a cleaning device for the outer surface of the tubular member 6. A guide ring 83 is inserted between the bushing 8 and the outer surface of the tubular member 6.

The telescoping tubular member 6 and all further, upper tubular members such as 9 and so on, are secured against rotation relative to each other by means of a groove 61 cooperating with a guide cam or pin 85 extending through the bushing 8 into the groove 61. Similar guide cams, not shown, are located in the bushing 11 for cooperation with a respective groove in the tubular member 9.

The free cross sectional area of the grooves 61 relative to the size or width of the cam 85 is selected to provide an adequate venting and air admission to the dead space 86, 116 confined radially between the tubular members 5 and 6 or 6 and 9 and axially between the upwardly facing surface portions of the piston 7, 10 and the respective guide ring 72 as well as between the axially facing surfaces of the respective guide ring 83. The dead space 86 is vented when the antenna is extended and air is admitted into this space when the antenna is retracted.

The second telescoping tubular member 9 is arranged inside the tubular member 6 in a similar manner as the latter is arranged in the tubular member 5. Thus, the piston 10 is of the same structure as the piston 7 and so is the guide bushing 11 relative to the guide bushing 8. Therefore, additional reference numbers are not used in the upper structure of the telescoping antenna mast. The tubular member 9 is closed by an antenna rotor 12 which may be driven electrically or hydraulically as is well known in the art.

A practical embodiment of a three stage light metal antenna mast according to the invention, comprises, for example, a lower tubular member 5 having an outer diameter of 90mm and the total retracted length is 4,100mm while the total extended length is 10,000mm. A mast of this size has a weight of about 38kg and the operating pressure of the gaseous or pneumatic medium was between 1 and 4.5 bar. An antenna of the just described size was secured with its lower tubular member at two locations spaced from each other by a spacing of 1800mm and with such a support the antenna had a wind load capability of 97 kilopond.

Incidentally, any valve or exchangeable orifice means as, mentioned above, would be located in the air passage 3 as well as in the air passages 75 and in the other passages not provided with separate reference numbers.

Although the invention has been described with reference to specific example embodiments, it is to be understood that it is intended to cover all modifications and equivalents within the scope of the appended claims.

What is claimed is:

1. A telescoping antenna mast comprising a plurality of hollow tubular members dimensioned so that progressively higher located tubular members fit into the next adjacent lower tubular member, each tubular member, except the lowest tubular member, having a lower end comprising piston means slidingly fitted into the next adjacent lower member, each piston means having gas passage means therethrough interconnecting the spaces in the hollow tubular members in succession, said lowest tubular member having gas port means connectable to a source of pneumatic pressure and openable, whereby the tubular members are extendible by pneumatic pressure admitted into said lowest tubular member, said tubular members comprising cylindrical walls, a longitudinal groove in each cylindrical wall except in the wall of the lowermost tubular member, each tubular member, except the uppermost tubular member, further comprising around its upper end bushing means slidingly receiving the next higher tubular member, and cam means in said bushing means positioned to engage the respective groove means in a sliding manner whereby the longitudinal telescoping movement of said tubular members is guided by said cam means and any rotational movement of one tubular member relative to any other tubular member is prevented.

2. The antenna of claim 1, wherein said lowest hollow tubular member comprises a bottom closure means, said gas port means being located in said bottom closure means, each tubular member, except for the uppermost, further comprising around its upper end bushing means slidingly receiving the next adjacent tubular member.

3. The antenna of claim 1, wherein each gas passage means through each piston means has a cross sectional area determined in accordance with the cross sectional area of the respective tubular member.

4. The antenna of claim 1, wherein said tubular members comprise an uppermost tubular member and closure means closing the upper end of said uppermost tubular member.

5. The antenna of claim 1, wherein a dead space is provided between adjacent tubular members, said cam means having sufficient play in their respective groove for venting said dead space.

6. The antenna of claim 1, wherein said gas port means are adapted for venting all tubular members through said gas passage means, whereby the antenna may be retracted due to its own weight by venting the tubular members.

7. The antenna of claim 6, wherein said gas passage means comprise cross sectional area determining means.

8. The antenna of claim 7, wherein said cross sectional area determining means comprise orifice means having orifice openings of different cross sectional area for each tubular member.

9. The antenna of claim 8, wherein said orifice means are exchangeable.

10. The antenna of claim 1, wherein said gas port means comprise orifice means having an orifice opening of fixed cross sectional area.

11. The antenna of claim 10, wherein said orifice means are exchangeable.

12. The antenna of claim 1, wherein said hollow tubular members are made of light metal.

* * * * *